US006202889B1

(12) United States Patent
Veith

(10) Patent No.: US 6,202,889 B1
(45) Date of Patent: Mar. 20, 2001

(54) UPRIGHT FACIAL TISSUE CARTON WITH IMPROVED TISSUE DISPENSING

(75) Inventor: Jerome Steven Veith, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/346,008

(22) Filed: Jul. 1, 1999

(51) Int. Cl.[7] ..... B65H 1/08
(52) U.S. Cl. ..... 221/58; 221/63
(58) Field of Search ..... 221/33, 45, 46, 221/47, 50, 56, 58, 59, 63; 206/556, 449

(56) References Cited

U.S. PATENT DOCUMENTS

| | | | |
|---|---|---|---|
| 2,761,584 | 9/1956 | Johnson et al. | 221/63 |
| 3,624,791 | 11/1971 | Taub | 221/59 |
| 3,881,632 * | 5/1975 | Early et al. | 221/50 |
| 4,231,491 | 11/1980 | Pierson et al. | 221/48 |
| 5,363,985 | 11/1994 | Cornell | 221/46 |
| 5,415,320 | 5/1995 | North et al. | 221/63 |

* cited by examiner

*Primary Examiner*—Kenneth W. Noland
(74) *Attorney, Agent, or Firm*—Thomas J. Connelly; Patricia A. Charlier

(57) ABSTRACT

An upright facial tissue carton is disclosed with improved tissue dispensing. The carton has a top wall, four sidewalls and a bottom wall. The top wall has an aperture formed therein through which the tissue can be withdrawn. An inverted U-shaped clip of interfolded tissue is positioned within the carton. The clip of tissue is maintained in close proximity to the aperture by a support means to facilitate singular dispensing of the tissues from the carton. The support means is formed from a flexible material that is folded into an inverted U-shape along with the clip of tissue.

17 Claims, 5 Drawing Sheets

UPRIGHT FACIAL TISSUE CARTON WITH IMPROVED TISSUE DISPENSING

FIELD OF THE INVENTION

This invention relates to an upright facial tissue carton with improved tissue dispensing. More specifically, this invention relates to an upright facial tissue carton having a support member for facilitating singular dispensing of the tissues from the carton.

BACKGROUND OF THE INVENTION

Facial tissue cartons come in a wide variety of shapes and sizes but they can generally be classified as either one of two basic styles. One style is the flat carton and the other is the upright carton. In a flat carton, the tissues are laid flat into the carton and are withdrawn from the top of the carton or through an opening in the top which partially extends downward into the front sidewall. The tissues within the carton may be interfolded for pop-up dispensing or merely laid on top of one another for reach-in dispensing. In an upright carton, the tissues are folded into an inverted U-shaped clip and are interfolded for pop-up dispensing. Each tissue is singularly withdrawn through a dispensing opening in the top of the carton, which may contain a polymeric film having a slit to hold the popped up tissue in place.

Both types of facial tissue cartons can experience dispensing problems after the number of tissues within the carton is reduced. This dispensing problem is primarily concerned with what is known by those skilled in the art as "fall back." Fall back occurs as the number of tissues within the carton is reduced and the distance between the uppermost tissue and the dispensing opening in the top of the carton increases. This can cause the uppermost tissue to fall back into the box rather than being retained by the opening for ready removal. In flat cartons having an opening in the front wall, each tissue has a flat orientation relative to an adjacent tissue and the dispensing opening is usually of a large size. These two features facilitate the insertion of a consumer's fingers into the carton such that the uppermost tissue can be grasped and removed. Upright cartons present a distinct difference in that the tissues retained in the carton are folded into an inverted U-shape and the dispensing opening is usually of a smaller size than that formed in flat cartons. Because of these two features, the problem associated with trying to withdraw the uppermost tissue after it has fallen back into the carton is more difficult.

When a support member is utilized, there is a need for a quick and efficient method of folding the tissue and the support member together so that both can be simultaneously inserted into the carton. The method must not slow down the manufacturing process and has to be cost efficient.

In view of the above, it has been recognized that there is a need for an upright facial tissue carton with a supporting member for maintaining the tissue in close proximity to the dispensing opening for easy withdrawal.

SUMMARY OF THE INVENTION

Briefly, this invention relates to an upright facial tissue carton with improved tissue dispensing. The carton has a top wall, four sidewalls and a bottom wall. The top wall has an aperture formed therein through which the tissue can be withdrawn. An inverted U-shaped clip of interfolded tissue is positioned within the carton. The clip of tissue is maintained in close proximity to the aperture by a support means to facilitate singular dispensing of the tissues from the carton. The support means is formed from a flexible material that is folded into an inverted U-shape along with the clip of tissue.

The general object of this invention is to provide an upright facial tissue carton with improved tissue dispensing. A more specific object of this invention is to provide an upright facial tissue carton with a support member for facilitating singular dispensing of the tissues from the carton.

Another object of this invention is to provide an upright facial tissue carton with a support member for maintaining the tissue in close proximity to the dispensing opening for easy withdrawal.

A further object of this invention is to provide an upright facial tissue carton with a support member which is economical to produce and easy to insert into the carton.

Still another object of this invention is to provide an upright facial tissue carton with a support member that can be folded along with the clip of tissue before being inserted into the carton.

Still further, an object of this invention is to provide an upright facial tissue carton with a support member that is made of cardboard.

Other objects and advantages of the present invention will become more apparent to those skilled in the art in view of the following description and the accompanying drawings.

DETAILED DESCRIPTION OF THE PREFERRED EMBODIMENTS

Figure 1:
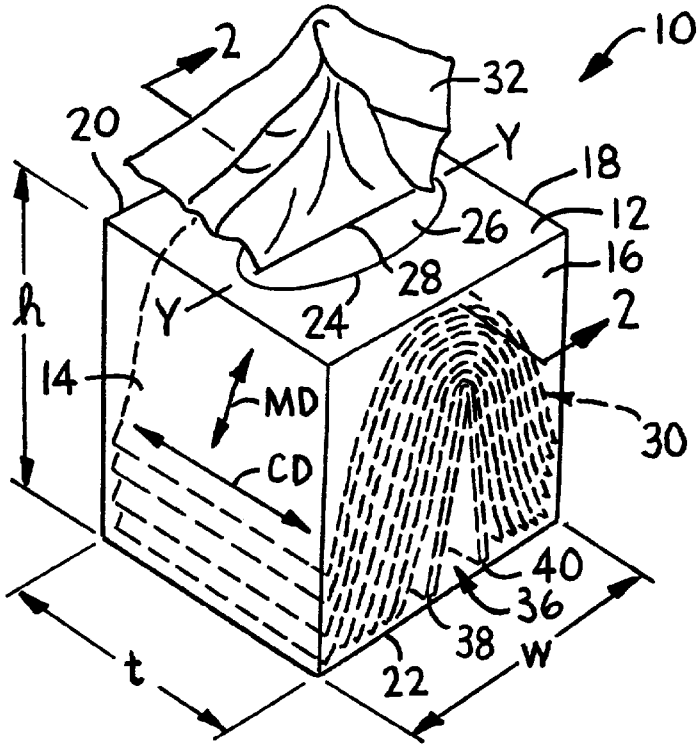
FIG. 1 is a perspective view of an upright facial tissue carton having a dispensing opening formed in a top surface thereof and having an inverted U-shaped clip of interfolded tissues positioned therein along with a support member.

Referring to FIG. 1, an upright facial tissue carton 10 is shown having a top wall 12, four side walls 14, 16, 18 and 20 and a bottom wall 22. The carton 10 can be assembled into a rectangular shaped box having a width "w", a depth or thickness "t" and a height "h". The width, thickness and height dimensions can be any desired measurement. An upright carton 10 manufactured by Kimberly-Clark Corporation has a width "w" of about 4.25 inches (about 108 millimeters (mm), a thickness "t" of about 4.25 inches (about 108 mm) and a height "h" of about 4.75 inches (about 121 mm). In constructing an aesthetically pleasing carton 10, it is recommended that the height "h" dimension be greater than the width "w" dimension and also be greater than the thickness "t" dimension. The width "w" dimension can equal the thickness "t" dimension if so desired. Furthermore, the carton 10 can be formed as a cube wherein the width, thickness and height are approximately of the same dimension.

The top wall 12 of the carton 10 has an aperture 24 formed therein. The aperture 24 is preferably an enlarged opening and can be of any desired geometrical configuration.

An oval, elliptical or circular shape is preferred. When the aperture 24 has an oval or elliptical shape, it will have a longitudinal centerline y—y. The aperture 24 can be completely open or it can be temporarily closed by a piece of material that can be easily removed prior to use by the consumer. Alternatively, the aperture 24 can be covered by a flexible, thin plastic film 26 which spans across or over the open area of the aperture 24.

The plastic film 26 can be attached to either the inside or outside surfaces of the top wall 12. The plastic film 26 can contain a dispensing opening 28 formed therein. The dispensing opening can be a single slit as depicted in FIG. 1 or it can take on various cross or x-shaped configuration as are taught in U.S. Pat. No. 5,415,320 issued to North et al. and assigned to Kimberly-Clark Corporation. This patent is incorporated by reference and made a part hereof.

Figure 3:
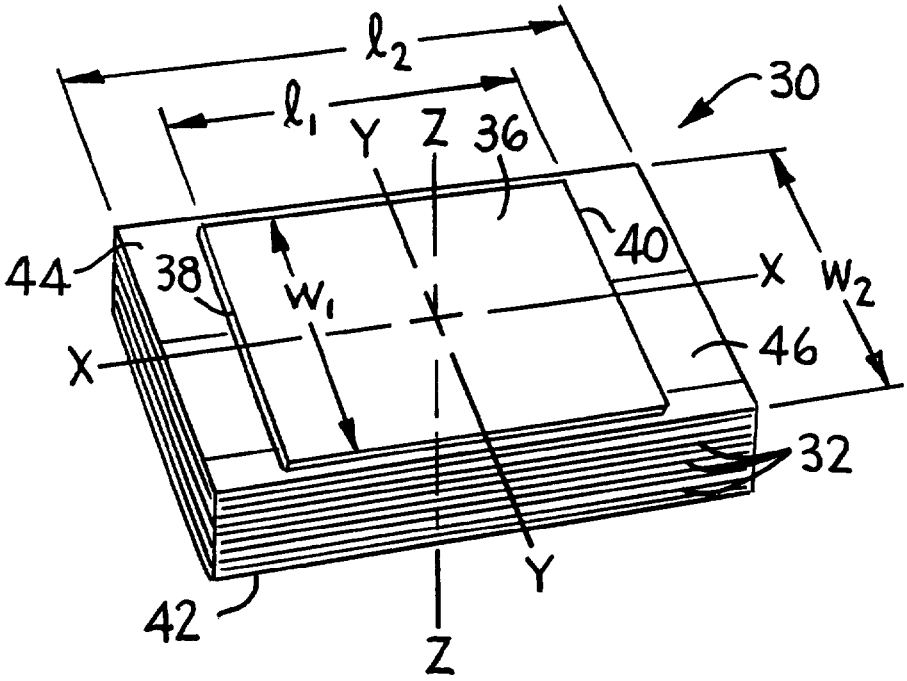
FIG. 3 is a bottom view of a flat clip of interfolded tissues having a support member positioned thereon.

Positioned within the carton 10 is an inverted U-shaped clip of tissues 30 indicated by the phantom lines. The clip of tissues 30 is made up from a plurality of individual tissues 32. The exact number of tissues 32 can vary depending on the size of the carton 10. A small carton may contain up to about 50 tissues while a regular size carton may contain from between about 60 to about 100 tissues. Larger cartons can contain from between about 125 to about 200 or more tissues. The tissues 32 forming the clip of tissues 30 are preferably interfolded. By "interfolded" it is meant that each tissue 32 is at least partially folded with the adjacent tissue(s). Interfolding the tissues 32 create a beneficial feature in that as the first tissue 32 is pulled up out of the carton 10, it will cause the next tissue 34 to raise up and start to follow the first tissue out of the carton 10. Each tissue 32 will have a "total surface area" which can vary per container and the interfold with the adjacent tissue(s) should occupy from between about 20 percent to about 50 percent of the total surface area of each tissue 32. It should be noted that each tissue 32 can be folded in either its machine direction (MD) or in its cross-direction (CD). The orientation of the tissue 32 relative to its machine direction or cross-direction will depend upon the equipment used to fold the tissue. In FIG. 3, the machine direction is parallel to the x—x axis while the cross-direction is parallel to the y—y axis. A multifolder or an interfolder are two different types of equipment that can be used to fold the tissue 32.

Figure 2:
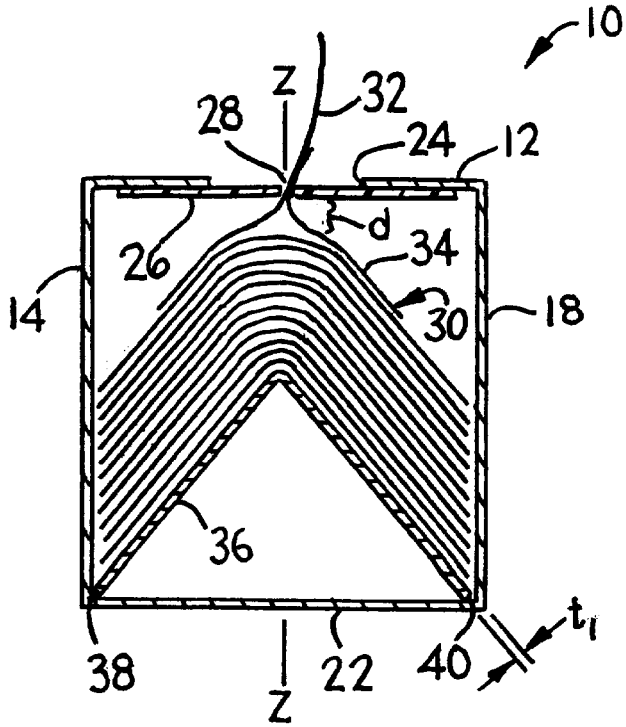
FIG. 2 is a side view of the upright facial tissue carton shown in FIG. 1 after a number of tissues have been withdrawn showing how the support member maintains the tissue in close proximity to the dispensing opening for easy withdrawal.

Referring to FIG. 2, a plastic film 26 is shown attached to the underside of the top wall 12. The plastic film 26 contains a slit 28 that is aligned vertically below the aperture 24. The slit 28 can have the shape of a single elongated line, two or more intersecting lines, or some other geometrical configuration. Preferably, the machine direction of the tissue 32 is aligned parallel to the slit 28 when the slit 28 has the shape of a single elongated line. During dispensing, the top tissue 32 of the clip of tissues 30 is grasped by the user and is pulled through the dispensing opening slit 28 and through the aperture 24. Removal of the top tissue 32 causes the next adjacent interfolded tissue 34 to follow. In doing so, the next adjacent tissue 34 will be partially pulled through the dispensing opening slit 28. This partially dispensed tissue will then be held upright in a popped-up position by the edges of the dispensing opening slit 28.

Still referring to FIG. 2, one will notice that after a number of the tissues 32 have been removed from the clip 30, the vertical distance "d" between the dispensing slit 28 and the uppermost tissue 34 of the remaining clip of tissues 30 will increase. This vertical distance "d" is measured along the vertical axis z—z of the carton 10. A typical upright facial tissue carton 10 has a height "h" of from between about 4 inches to about 6 inches (about 102 mm to about 153 mm). In a filled carton 10, the uppermost tissue 32 will be positioned immediately adjacent to the dispensing slit 28 and the distance "d" will be essentially zero. As the uppermost tissues 32 are withdrawn from the clip 30, the distance "d" will increase and can extend to a dimension of greater than about 2 inches (about 51 mm). As the distance "d" increases, there is a likelihood that the tissue 32 being removed through the dispensing opening slit 28 will separate from the next adjacent (lower) tissue 34 and the lower tissue 34 will fall back into the carton 10. Once this occurs, the user is forced to extend their fingers through the dispensing slit 28 and try to retrieve the uppermost tissue 34. Because of the relatively small size of the dispensing slit 28 and the extent of the distance "d", the task of retrieving the uppermost tissue 34 can become cumbersome.

Furthermore, it has been noticed that after a number of tissues 32 have been removed from the carton 10, the weight of the remaining tissues 32 can cause the tissue 32 to collapse upon themselves. This action can cause the uppermost tissue 32 to separate from the next adjacent (lower) tissue 34. This action will break the progression of successive tissue 32 being held upright by the slit 28 formed in the plastic film 26. In order to prevent this from occurring, a support member 36 is positioned within the carton 10. The size, shape and construction of the support member 36, along with its interaction with the clip of tissues 30 and insertion into the carton 10 will be explained with reference to FIGS. 3–6.

Referring to FIG. 3, the support member 36 is designed to prevent and eliminate "fall back" from occurring within the carton 10. The support member 36 should be a low cost item that is easily inserted into the carton 10 in order to keep the cost of the product at a minimum value. The support member 36 is shown as a planar member formed from a flexible material and having the capability of being folded at least once. Preferably, the support member 36 can be folded into an inverted U-shape along with the clip of tissues 30. The support member 36 should be flexible and may also contain a certain degree of resiliency. By "resiliency" it is meant that after the support member 36 is folded that it will possess the ability to at least partially recover or move back towards its original shape. The materials from which the support member 36 can be formed include, but are not limited to, the following: cardboard, thick paper, wooden veneer, plastic, thermoplastic, polymers including polyethylene and polypropylene, as well as a laminate formed from two or more different materials, etc. The preferred material is cardboard. The support member 36 should have a thickness of less than about 2 millimeters. Preferably, when the support member 36 is cardboard, it will have a thickness of from between about 0.01 inches to about 0.03 inches (about 0.25 mm to about 0.76 mm).

The primary function of the support member 36 is to facilitate singular dispensing of the tissue 32 from the carton 10. This is accomplished by minimizing the distance "d" which the uppermost tissue 32 can be spaced away from the dispensing opening 28. Even if the uppermost tissue should separate from the next adjacent tissue 34, the distance the next adjacent tissue 34 is located away from the dispensing opening 28 will be kept to a minimum. This will prevent "fallback" so a consumer is able to insert their fingers into the carton 10 and retrieve the next adjacent tissue 34 in a non-arduous manner. The support member 36 will also prevent a partial clip of tissue 30 from collapsing upon itself.

Still referring to FIG. 3, the support member 36 is shown as a flat, rectangular member having a predetermined length $l_1$ and width $w_1$. The support member 36 can have other shapes, if desired such as trapezoidal, square, oval, etc. The support member 36 also has a first end 38 and a second end 40 that are spaced apart from one another. The support member 36 is shown being positioned on a clip of tissue 30. The clip of tissue 30 has a first surface 42, an oppositely aligned second surface 44 and a doubled fold 46 formed only in the uppermost tissue 32. The double fold 46 facilitates removal of the uppermost tissue 32 from the carton 10. The support member 36 is depicted as being positioned adjacent to the second surface 44 although it could be positioned adjacent to the first surface 42, if desired. The support member 36 is positioned below the clip of tissue 30 when placed in the carton 10. However, when assembling both the clip of tissue 30 and the support member 36, the support member 36 can be positioned so that the plurality of tissues 32 can be stacked on top of it. Alternatively, the support member 36 can be positioned above the clip of tissue 30 once it has been assembled.

The clip of tissue 30 can include from between about 25 to about 500 individual tissues 32. Each of tissues 32 forming the clip of tissues 30 can be interfolded or somehow directly or indirectly connected or arranged relative to the next adjacent tissue 32. Each tissue 32 has a predetermined length $l_2$ and width $w_2$. The length $l_2$ of each individual tissue 32 can be any desired dimension but normally will range from between about 8 inches to about 10 inches (about 203 mm to about 254 mm). The width $w_2$ of each individual tissue 32 can be any desired dimension but normally will range from between about 3 inches to about 5 inches (about 76 mm to about 127 mm) after it has been folded once along its longitudinal centerline. The length $l_1$ of the support member 36 should be less than the length $l_2$ of the individual tissues 32. Preferably, the length $l_1$ of the support member 36 should be from between about 10 percent to about 40 percent shorter than the length $l_2$ of the tissue 32. Another way of forming the support member 36 is to size it from between about 1 inch to about 3.5 inches (about 25.4 mm to about 89 mm) shorter than the length $l_2$ of the tissue 32. Preferably, the length $l_1$ of the support member 36 will be greater than about 6.5 inches (about 165 mm) so as to facilitate its insertion into the upright facial tissue carton 10 having a height of about 5.25 inches (about 133 mm). The reason the length $l_1$ of the support member 36 should be less than the length $l_2$ of the individual tissues 32 is that if the support member 36 is longer, it could interfere with the total number of tissues 32 that can be inserted into the carton 10.

The support member 36 has a width "$w_1$" which can be equal to or less than the width "w" of the carton 10. The width "$w_1$" of the support member 36 can vary but preferably will be about 4.25 inches (about 108 mm) so as to be easily assembled with the clip of tissue 30. The support member 36 has a thickness "$t_1$" (see FIG. 2) of from between about 0.01 inches to about 0.03 inches (about 0.25 mm to about 0.76 mm). Preferably, the thickness "$t_1$" is about 0.01 inches (about 0.25 mm) so that it is easy to fold and low in cost. The width $w_1$ of the support member 36 can be greater than, equal to or less than the width $w_2$ of the individual tissues 32. In addition, the width $w_1$ of the support member 36 will be equal to or less than the width "w" of the carton 10. The width $w_1$ of the support member 36 preferably will be approximately equal to the width $w_2$ of the individual tissues 32.

Figure 4:
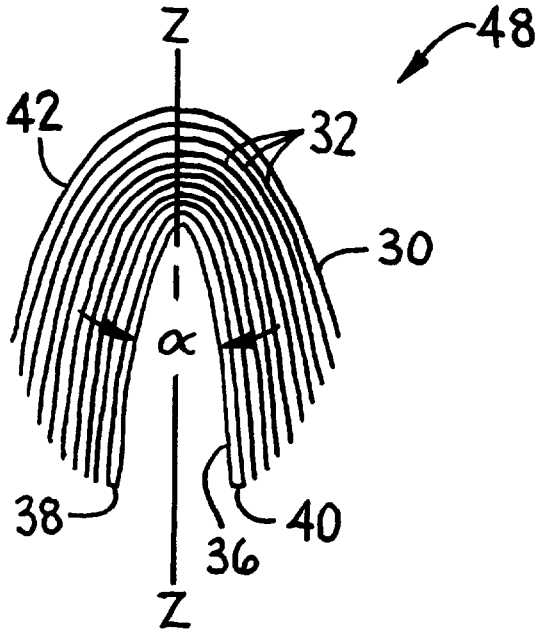
FIG. 4 is a side view of the clip of tissue and support member shown in FIG. 3 folded once along the central transverse axis.
Figure 5:
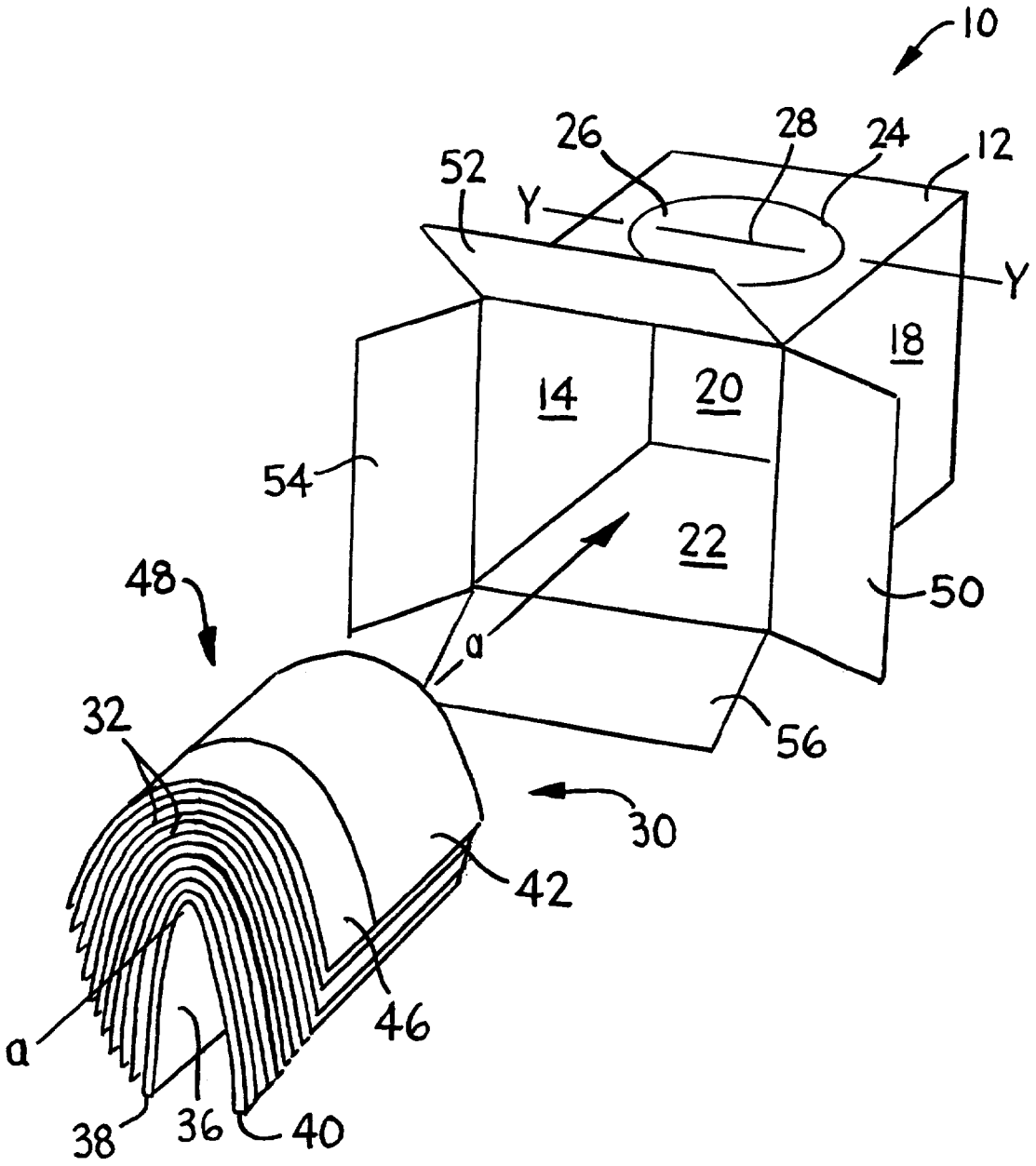
FIG. 5 is an exploded view shown the orientation of the folded clip of tissue and support member being inserted into an upright facial tissue carton.

Referring to FIGS. 4 and 5, the combination clip of tissue 30 and support member 36 are folded together along a fold line a—a (see FIG. 5) to obtain an inverted U-shaped configuration 48. The fold line a—a can be aligned along the transverse axis y—y or be aligned parallel thereto. The fold line a—a can also be offset from the y-axis, if desired. The support member 36 should be flat or planar and relatively thin such that it will fold easily. The combination clip of tissue 30 and support member 36 is folded simultaneously with the support member 36 being located on the inside of the inverted U-shaped configuration 48. The support member 36 can be completely folded such that the first end 38 touches or contacts the second end 40 or it can be folded such that the first end 38 is disposed at an angle alpha ($\alpha$) to the second end 40. The angle alpha ($\alpha$) can range from between about 1° to about 60°. Preferably, the angle alpha ($\alpha$) ranges from between about 5° to about 30°, and more preferably, from between about 5° to about 20°.

It should be noted that the combination clip of tissue 30 and support member 36 is shown folded once but additional folds may be employed if desired.

Referring now to FIG. 5, the inverted U-shaped configuration 48 is shown being ready to be inserted into an upright carton 10. The inverted U-shaped configuration 48 is preferably inserted such that the fold line a—a is aligned perpendicular to the dispensing opening slit 28 formed in the top wall 12 of the carton 10. This will assure that the first tissue 32 with its double fold 46 will be readily available to be withdrawn through the dispensing opening slit 28 by the user. If the carton 10 does not utilize a dispensing opening slit 28 but instead only has an aperture 24, the inverted U-shaped configuration 48 can be inserted such that the fold line a—a is either parallel or perpendicularly aligned to the longitudinal axis y—y of the aperture 24. After being inserted into the carton 10, the support member 36 will retain its inverted U-shaped configuration 48. Initially, the first and second ends, 38 and 40 respectively, will be spaced away from the two sidewalls, 14 and 18 respectively. The first and second ends, 38 and 40 respectively, can be in contact with an inside surface 58 of the bottom wall 22. It is not necessary that both of the first and second ends 38 and 40 contact the inside surface 58 of the bottom wall 22 but at least one of the ends 38 or 40 should. As the tissue 32 is withdrawn from the carton 10, the first and second ends 38 and 40 are free to gradually move outward and closer towards the respective sidewalls 14 and 18. This action will prevent the tissue 32 from collapsing upon itself and falling down towards the bottom wall 22 and away from the dispensing opening 28. The support member 36 also facilitates singular dispensing of the tissue 32 from the carton 10 by keeping the tissues 32 in close proximity to the dispensing opening 28.

In FIG. 5, the carton 10 is shown having four flaps 50, 52, 54 and 56 that form the sidewall 16. Other arrangements for forming the sidewall can also be utilized. The four flaps 50, 52, 54 and 56 are opened to allow the inverted U-shaped configuration to be inserted and are then closed and/or sealed to form a box shaped carton 10. The flaps 50–56 can be closed by interfolding one or more of the flaps 50–56 and can be sealed by using an adhesive, glue, staples, or any other known attachment or securement means.

Method

Figure 6:
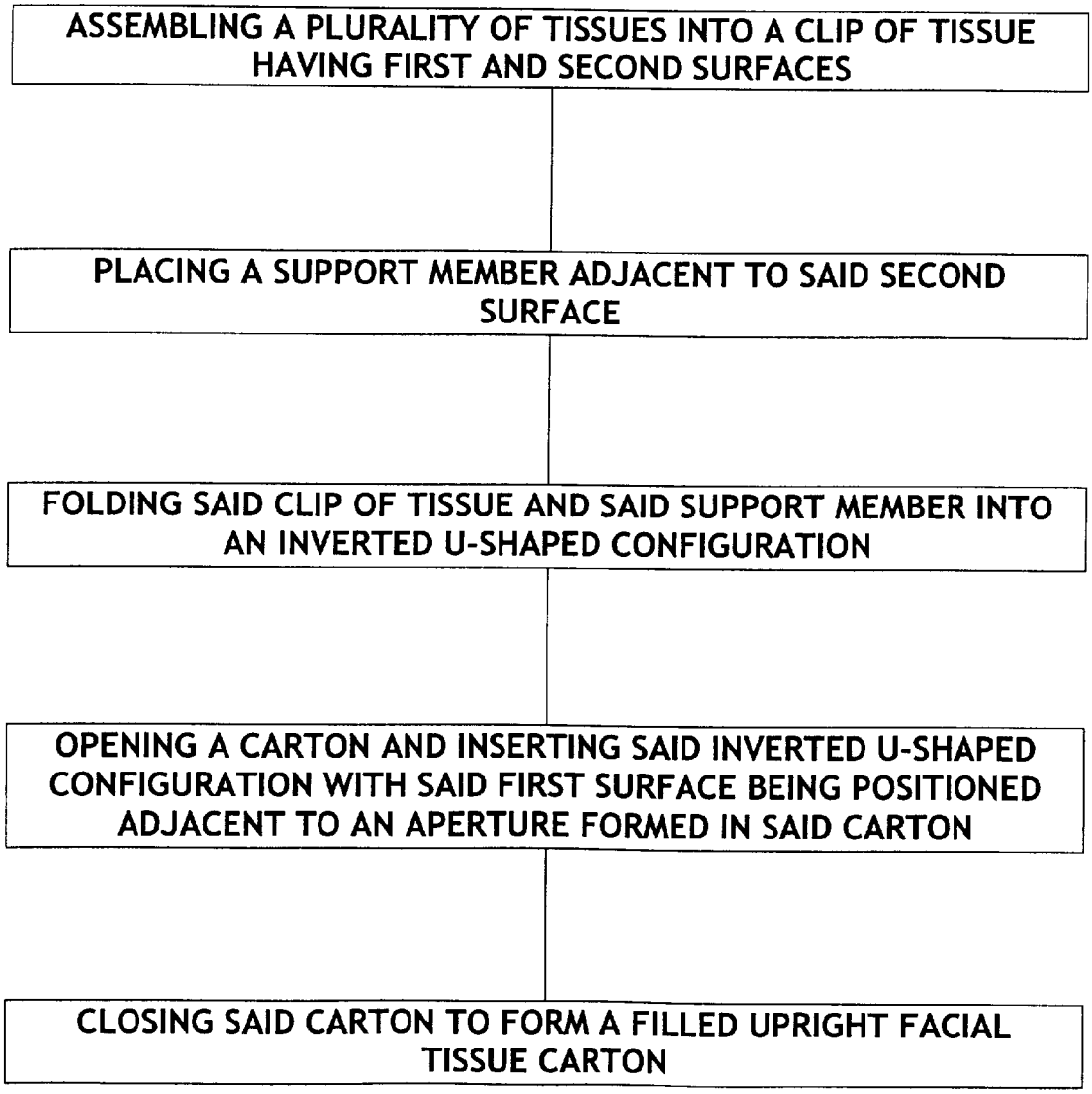
FIG. 6 is a flow diagram of a method of filling an upright facial tissue carton with tissue and a support member to facilitate individual dispensing of the tissue.

The method of filling an upright facial tissue carton 10 with a clip of tissue 30 and a support member 36 to facilitate individual dispensing of the tissue 32 will now be explained with reference to the flow diagrams shown in FIGS. 6 and 7. In FIG. 6, one method of filling the carton 10 is to assemble a plurality of tissue 32 into a clip of tissue 30 having a first surface 42 and a second surface 44. The clip of tissue 30 can contain at least 50 individual tissues 32. Preferably, the clip of tissue 30 can contain at least 100 individual tissues 32 and, most preferably, the clip of tissue 30 can contain at least 150 individual tissues 32. A support member 36 is placed adjacent to the second surface 44. Preferably, the support member 36 is a flat, planar member that is longitudinally centered on the clip of tissue 30. A support member 36 formed from a thin piece of cardboard works well and is inexpensive. Both the clip of tissue 30 and the support member 36 are folded into an inverted U-shaped configuration 48. The clip of tissue 30 and the support member 36 can be folded on a fold line a—a that is transversely aligned to the clip of tissue 30. The clip of tissue 30 and the support member 36 are preferably only folded once.

An upright facial tissue carton 10 is constructed having a top wall 12, four sidewalls 14, 16, 18, and 20 and a bottom wall 22. The top wall 12 has an aperture 24 formed therein. The aperture is preferably an enlarged opening having a longitudinal axis y—y. A flexible, plastic film 26 can optionally be secured to the top wall 12. The plastic film 26 has a dispensing opening 28 formed therein which holds an individual tissue 32 in an upright orientation as it passes by the film 26. The dispensing opening 28 can be formed from one or more intersecting slits. The carton 10 is opened to receive the inverted U-shaped configuration 48. One way to open the carton 10 is to open the flaps 50, 52, 54 and 56 that form a sidewall 16. The inverted U-shaped configuration 48 is then inserted such that the first surface 42 of the clip of tissue 30 is positioned adjacent to the aperture 24 formed in the top wall 12 of the carton 10. When the plastic film 26 is utilized, the first surface 42 of the clip of tissue 30 will be aligned adjacent to the dispensing opening 28 formed in the plastic film 26. Furthermore, when the plastic film 26 is present, the sidewall 16 that is opened should be aligned parallel to the longitudinal axis y—y of the aperture 24. When the dispensing opening 28 is a single elongated slit, the sidewall 16 should be aligned parallel to it. This orientation allows the length $l_2$ of each tissue 32 to be aligned parallel to the longitudinal axis y—y of the aperture 24 and/or parallel to the slit 28. The carton 10 is then closed to form a filled upright facial tissue carton. When the sidewall 16 is constructed from four flaps 50, 52, 54 and 56, the flaps 50–56 can be closed and sealed to form a box shaped carton 10. The carton 10 can be sealed with an adhesive.

In the above method, the support member 36 can be sized to have a shorter length $l_1$ than the length $l_2$ of the tissue 32. This facilitates getting the maximum number of tissues 32 into the carton 10 along with the support member 36. It is also advantageous in dispensing the tissue 32 if each tissue 32 is interfolded with an adjacent tissue 32. The apparatus and method of interfolding individual tissues 32 is known to those skilled in the tissue art.

Figure 7:
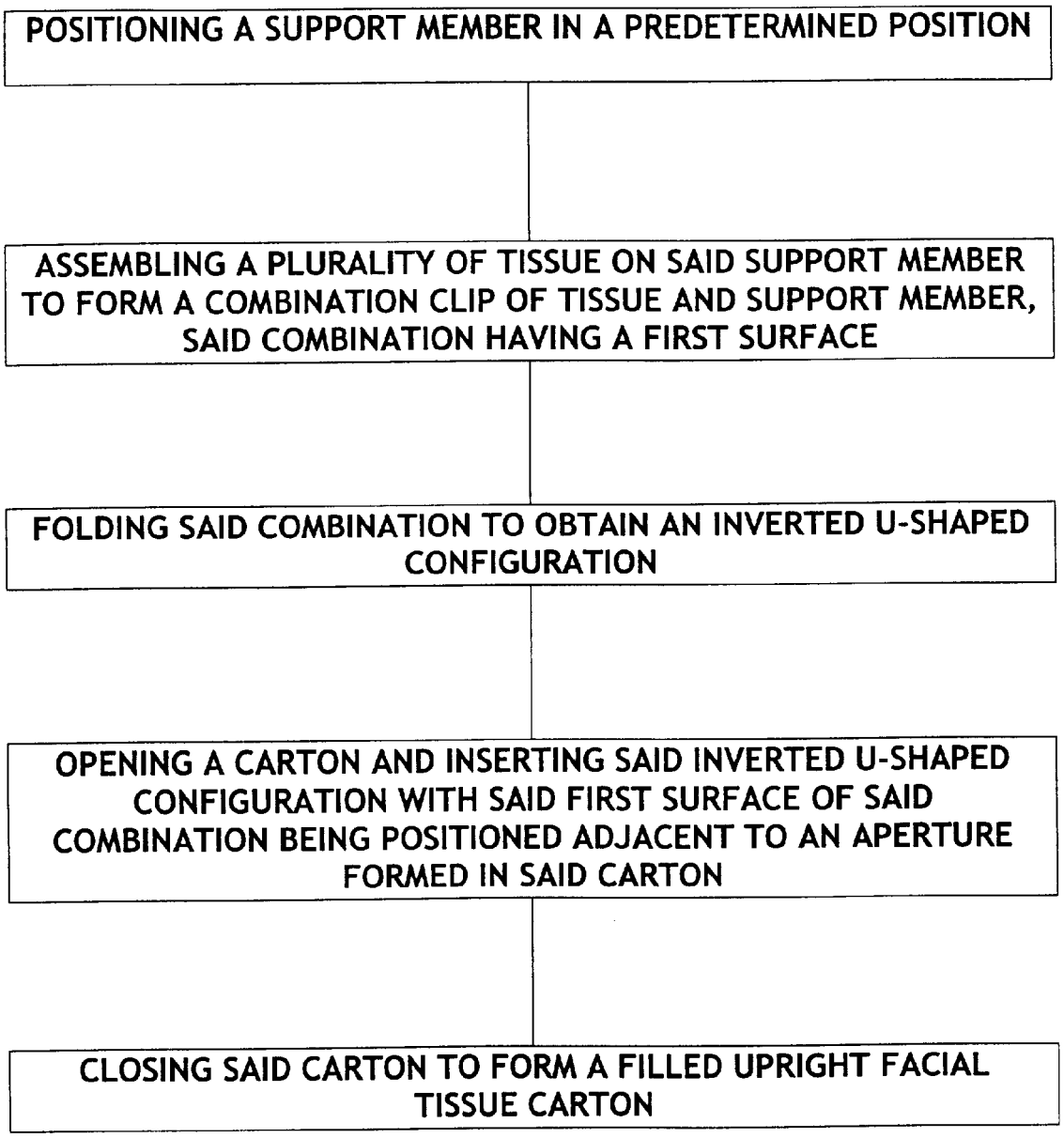
FIG. 7 is a flow diagram of an alternative method of filling an upright facial tissue carton with tissue and a support member to facilitate individual dispensing of the tissue.

Referring now to FIG. 7, an alternative method of filling an upright facial tissue carton 10 with a clip of tissue 30 is taught. In this method, a support member 36 is positioned in a predetermined location. A plurality of tissue 32 are then assembled on the support member 36 to form a combination clip of tissue 30 and support member 36. The combination has a first surface 42. It should be noted that the tissue 32 can first be assembled into a clip of tissue 30 which is positioned on the support member 36 or each tissue 32 can be individually stacked onto the support member 36. The combination is then folded to obtain an inverted U-shaped configuration 48. The carton 10 is opened and the U-shaped configuration 48 is inserted such that the first surface 42 is positioned adjacent to the aperture 24 formed in the top wall 12 of the carton 10. The carton 10 is then closed and sealed to form a filled upright facial tissue carton 10.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations that fall within the spirit and scope of the appended claims.

I claim:

1. An upright facial tissue carton with improved tissue dispensing comprising:

a) a carton having a top wall, four sidewalls and a bottom wall, said top wall having an aperture formed therein;

b) an inverted U-shaped clip of interfolded tissues positioned within said carton, wherein said clip of tissue includes a plurality of tissues each having a predetermined length and width and said support means is a rectangular member having a predetermined length and width, and the length of said support member is less than the length of said tissue; and c) support means for maintaining said inverted U-shaped clip of tissues in close proximity to said aperture to facilitate singular dispensing of said tissues from said carton, said support means being formed from a flexible material which is folded into an inverted U-shape along with said clip of tissue.

2. The upright facial tissue carton of claim 1 wherein the width of said support member is approximately equal to the width of said tissue.

3. The upright facial tissue carton of claim 1 wherein said support means is a flat member having first and second spaced apart ends.

4. The upright facial tissue carton of claim 3 wherein said support member is folded once along with said clip of tissue to form an inverted U-shaped configuration and is positioned in said carton such that at least one of said first and second ends contact said bottom wall.

5. The upright facial tissue carton of claim 4 wherein said first and second ends are initially spaced away from two of said sidewalls and said first and second ends move closer towards said two respective sidewalls as tissue is withdrawn from said carton.

6. The upright facial tissue carton of claim 1 wherein said support means is made from a material containing a certain degree of resiliency.

7. The upright facial tissue carton of claim 1 wherein said support means is cardboard.

8. The upright facial tissue carton of claim 1 wherein said aperture formed in said top wall of said carton is oval shaped.

9. An upright facial tissue carton with improved tissue dispensing comprising:

a) a carton having a top wall, four sidewalls and a bottom wall, said top wall having an enlarged aperture formed therein;

b) an inverted U-shaped clip of interfolded tissues positioned within said carton, wherein said support means is a flat member having first and second spaced apart ends and said first and second ends are free to move outward away from one another as said tissue is withdrawn from said carton; and c) support means for maintaining said inverted U-shaped clip of tissues in close proximity to said aperture to facilitate singular dispensing of said tissues from said carton, said support means being formed from a flexible material which is folded into an inverted U-shape along with said clip of tissue, and said support means preventing said tissue from collapsing upon itself.

10. The upright facial tissue carton of claim 9 wherein said flexible material is cardboard.

11. The upright facial tissue carton of claim 9 wherein said support means is folded once along with said clip of tissue and is positioned in said carton such that at least one of said first and second ends contact said bottom wall.

12. The upright facial tissue carton of claim 11 wherein said first and second ends are initially spaced away from two of said sidewalls and said first and second ends move closer towards said two respective sidewalls as tissue is withdrawn from said carton.

13. An upright facial tissue carton with improved tissue dispensing comprising:

a) a carton having a top wall, four sidewalls and a bottom wall, said top wall having an enlarged aperture formed therein;

b) a flexible plastic film attached to said top wall, said flexible plastic film having a dispensing opening through which said tissues are withdrawn from said carton;

c) an inverted U-shaped clip of interfolded tissues positioned within said carton, wherein said clip of tissue includes a plurality of tissues each having a predetermined length and width and said support means is a rectangularly shaped member having a predetermined length and width, and the length of said support member is less than the length of said tissue; and d) support means for maintaining said inverted U-shaped clip of tissues in close proximity to said dispensing opening to facilitate singular dispensing of said tissues from said carton, said support means being formed from a flexible material which is folded into an inverted U-shape along with said clip of tissue, and said support means preventing said tissue from collapsing upon itself.

14. The upright facial tissue carton of claim 13 wherein said flexible material is cardboard.

15. The upright facial tissue carton of claim 13 wherein said support member has a thickness of from between about 0.01 inches to about 0.03 inches.

16. The upright facial tissue carton of claim 13 wherein said support member has a length that is from between about 10% to about 40% shorter than the length of said tissue.

17. The upright facial tissue carton of claim 13 wherein said carton has a width and said support means has a width that is equal to or less than the width of said carton.

* * * * *